US007584873B2

(12) United States Patent
Grittmann

(10) Patent No.: US 7,584,873 B2
(45) Date of Patent: Sep. 8, 2009

(54) DISPENSING CONTAINER FOR CARBONATED BEVERAGES

(76) Inventor: Günter Grittmann, Ringstrasse 6, 75031 Eppingen-Mühlbach (DE)

( * ) Notice: Subject to any disclaimer, the term of this patent is extended or adjusted under 35 U.S.C. 154(b) by 516 days.

(21) Appl. No.: 11/433,581

(22) Filed: May 15, 2006

(65) Prior Publication Data

US 2006/0255076 A1 Nov. 16, 2006

(30) Foreign Application Priority Data

May 14, 2005 (DE) ..... 10 2005 022 446

(51) Int. Cl.
*B65D 83/00* (2006.01)

(52) U.S. Cl. ..... 222/399; 222/394; 222/396; 222/400.7; 222/518; 222/534; 222/536; 222/559; 251/353

(58) Field of Classification Search ..... 222/399, 222/394, 396, 400.7, 400.8, 135, 386.5, 518, 222/520–525, 534–536, 553, 559, 538–539; 137/540; 251/349, 351, 353–354
See application file for complete search history.

(56) References Cited

U.S. PATENT DOCUMENTS 1,859,126 A * 5/1932 Boeuf ..... 222/505
2,112,317 A * 3/1938 Valentine ..... 222/539
2,764,385 A * 9/1956 Sieling ..... 251/144
2,841,314 A * 7/1958 Munson et al. ..... 222/519
3,237,818 A * 3/1966 Bijvoet ..... 222/522
3,272,404 A * 9/1966 Graves et al. ..... 222/396
3,613,954 A * 10/1971 Bayne ..... 222/61
3,815,793 A * 6/1974 Morane et al. ..... 222/399
3,976,221 A * 8/1976 Martin et al. ..... 222/61
4,802,610 A * 2/1989 Cheek et al. ..... 222/481.5
5,562,235 A * 10/1996 Cruysberghs ..... 222/396
6,053,475 A 4/2000 Batschied et al.
6,260,823 B1 * 7/2001 Weber ..... 251/351
6,401,989 B1 6/2002 Grittmann
6,415,963 B1 * 7/2002 Vlooswijk et al. ..... 222/396
6,742,682 B2 * 6/2004 Batschied et al. ..... 222/559
6,745,922 B1 6/2004 Vlooswijk et al.
2008/0041892 A1 2/2008 Neukirch et al.

FOREIGN PATENT DOCUMENTS

DE 25 21 099 11/1976
DE 35 15 762.7 U1 9/1985

(Continued)

*Primary Examiner*—Frederick C. Nicolas
(74) *Attorney, Agent, or Firm*—Foley & Lardner LLP

(57) ABSTRACT

A beverage container of the type having an internal $CO_2$ cartridge, that is adapted to be tapped from the outside and to be connected to a constant pressure-maintaining mechanism, has a tap provided on the upper edge of the container. The tap: is connected on its inner end with a riser line; comprises an outside tube in which an inside tube is slidably arranged; has a terminal coupling of the outside tube that is located at the end of the riser line; and is formed so that the inside tube comprises a projection which closes the riser line when the tap is in its pushed-in condition. A tapping actuator on the outer end of the inside tube operates a plunger that is connected to a tapered member that cooperates with a correspondingly tapered seat positioned within the inside tube.

14 Claims, 2 Drawing Sheets

FOREIGN PATENT DOCUMENTS

| | | | |
|---|---|---|---|
| DE | 35 15 762 | A1 | 11/1986 |
| DE | 42 02 633 | A1 | 8/1992 |
| DE | 296 18 397 | U1 | 2/1997 |
| DE | 297 22 034 | U1 | 2/1998 |
| DE | 198 35 569 | A1 | 2/2000 |
| DE | 203 10 836 | U1 | 9/2003 |
| EP | 1 151 961 | A1 | 11/2001 |
| WO | WO 2006/000437 | A | 1/2006 |

* cited by examiner

DISPENSING CONTAINER FOR CARBONATED BEVERAGES

CROSS-REFERENCE TO RELATED PATENT APPLICATIONS

The right of foreign priority is claimed under 35 U.S.C. § 119(a) based on Federal Republic of Germany Application No. 10 2005 022 446.6, filed May 14, 2005, the entire contents of which, including the specification, drawings, claims and abstract, are incorporated herein by reference.

BACKGROUND OF THE INVENTION

This invention relates to a beverage container, especially a dispensing container for carbonated beverages, and in particular a beer keg, especially a small container—a so-called party keg—with an integrally installed tap. Such kegs have been known for a long time; see, e.g. commonly assigned German Patent Publication No. 198 35 569 (corresponding to U.S. Pat. No. 6,401,989).

Such kegs use taps provided on the bottom, which are slidable into the keg's interior so that the kegs must stand on frames or adjacent an edge of a tabletop, in order that a glass to be filled can be held under the tap. This is a less convenient arrangement for such a party keg.

A further disadvantage with these kegs is that they must be vented after the reduction of the internal $CO_2$ pressure, in order to enable any continued flow of the beverage. Thus, if the keg is not immediately consumed, its contents will become flat and/or be subject to bacterial contamination as a result of the air vented into the keg.

U.S. Pat. No. 6,745,922 discloses a container for dispensing beverages, in particular beer, comprising in its inside a gas pressure vessel which permanently keeps the interior of the container at a desired $CO_2$ pressure level. Independent of this pressure unit, a tap connectable with a riser line is provided which, by pressing down a spring, opens a valve to convey a beverage via the riser line to the tap. The tap must be separately provided, i.e., so that it can be cleaned for re-use, since bacteria would otherwise deposit and propagate in it. This document is hereby incorporated by reference in its entirety.

SUMMARY OF THE INVENTION

One object according to the present invention is to provide a container for dispensing carbonated beverages, especially a so-called party keg, in which it is possible to provide the tap on the upper edge of the keg's jacket surface so that glasses can be filled above the level of the keg bottom. Another object of the invention resides in providing such a keg in which $CO_2$ overpressure is ensured while avoiding contact of the keg's contents with the ambient air, and in which the tap is integrated in the keg.

In accordance with one aspect of the present invention, there has been provided a beverage container that is adapted to accept a pressurizing system having an internal $CO_2$ cartridge that can be selectively tapped from outside the container, which has been sealed, and a mechanism for maintaining constant $CO_2$ pressure from the cartridge. The container comprises: a tap provided on the upper edge of the container and being axially movable between a storage position, in which it is contained substantially within the container volume, and an activated position, in which it protrudes from one of the container walls; a riser line positioned inside the container and connected to the tap; wherein, the tap comprises an outside tube in which an inside tube is slidably arranged, the outside tube being sealingly mounted in a container wall, a terminal coupling on the inner end of the outside tube for connecting to the riser, a projection on the inside tube for closing the riser line when the tap is in its storage position; a plunger positioned at the radially outer end of the inside tube, coupled with a device for selectively axially displacing the plunger; a tapered member that is axially displaceable by the plunger and tapers in the beverage exit direction of the inside tube, movably positioned in the inside tube, and a tapered seat positioned in the inside tube and cooperating with the tapered member to form a selectively openable seal.

In accordance with another aspect of the invention, there is provided a container for dispensing a carbonated beverage, comprising: a sealable container having associated therewith a self-contained system for providing a predetermined pressure level of $CO_2$ within the container volume; a tap provided on the upper edge of the container and being axially movable between a storage position, in which it is contained substantially within the container volume, and an activated position, in which it protrudes from one of the container walls; a riser line positioned inside the container and connected to the tap; wherein, the tap comprises an outside tube in which an inside tube is slidably arranged, the outside tube being sealingly mounted in a container wall, a terminal coupling on the inner end of the outside tube for connecting to the riser, a projection on the inside tube for closing the riser line when the tap is in its storage position, a tapered member that is axially displaceable in the inside tube and tapers in the beverage exit direction of the inside tube, and a tapered seat positioned in the inside tube and cooperating with the tapered member to form a selectively openable seal; and a device for selectively axially displacing the tapered member.

Further objects, features and advantages of the present invention will become apparent from the detailed description of preferred embodiments that follows, when considered together with the accompanying figures of drawing.

DETAILED DESCRIPTION OF THE PREFERRED EMBODIMENTS

Figure 1:
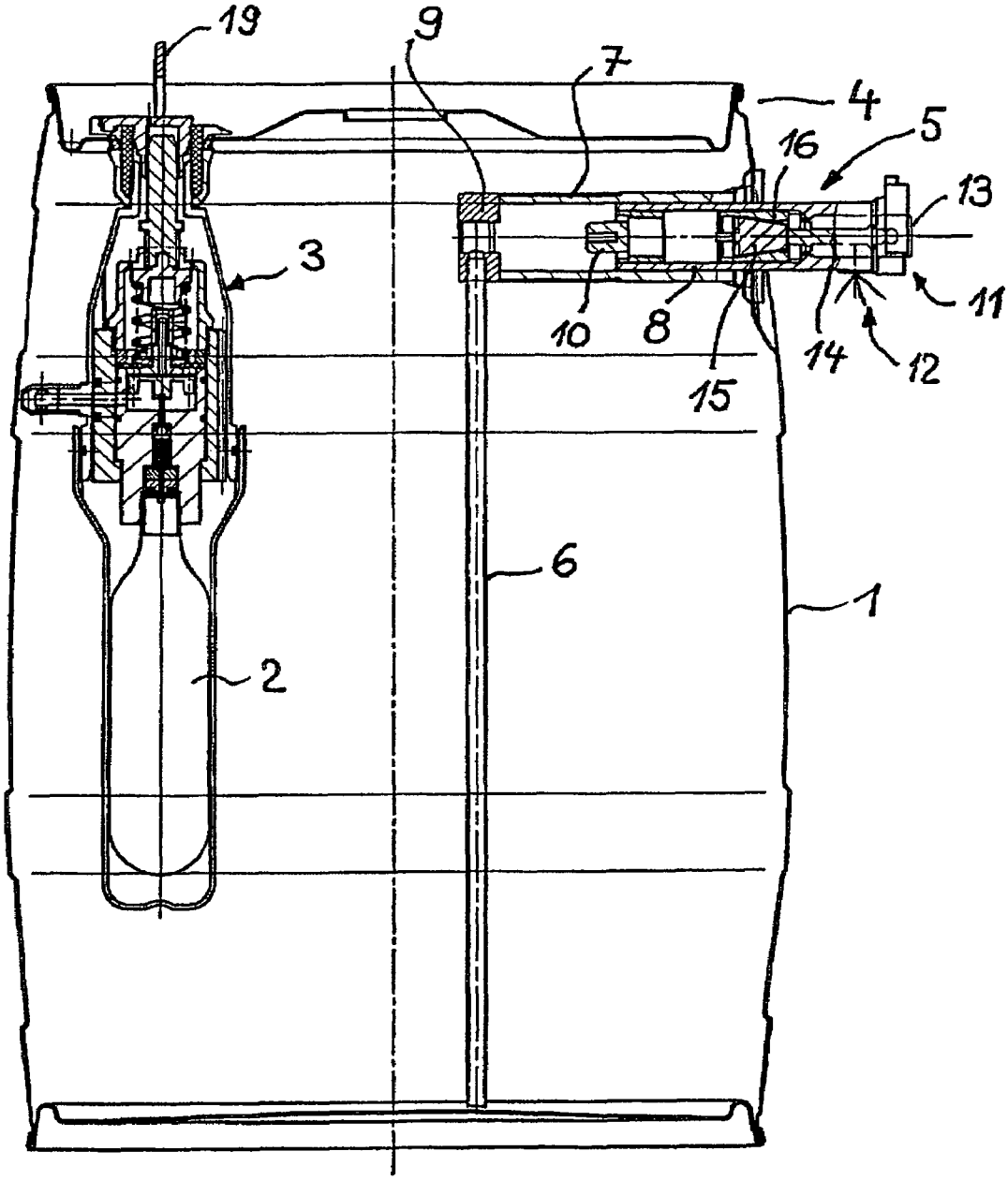
FIG. 1 is a sectional view showing one preferred embodiment of a keg according to the invention.

The beverage container according to the invention preferably has an internal $CO_2$ cartridge that can be tapped from the outside. A pressure-reducing mechanism with constant pressure maintenance is connected to the cartridge, and so is a tap that is provided on the upper edge of the keg. The tap is connected on its end with a riser line and comprises an outside tube in which an inside tube is slidably (telescopically) arranged, while the outside tube is held sealed in the keg jacket. The riser line ends in an end coupling of the outside tube, and the inside tube comprises a projection which closes the riser line when the tap is in a pushed-in condition. At the head (radially outer end) of the inside tube, there is an outlet as well as, on the external surface, a button with a plunger. The plunger is connected with a tapered closure or sealing member that narrows in the direction of the head of the inside tube, the tapered member being preferably conical and being received in a conical seat located within the inside tube. Other referenced designs and features are disclosed in more detail below.

Aside from the fact that the tap can now be provided on the top and that contact of the beverage with the air is avoided, another particular advantage of the present invention resides in its mode of operation. After tapping the $CO_2$ cartridge, or while the keg is at ambient temperature, its contents are under correspondingly high pressure. On the one hand, this easily results in the tap leaking; on the other hand, the beer will just foam excessively, so that one must wait a long time before being able to drink it. Moreover, excessive foaming has a negative effect on the taste. The preferred solution according to the invention provides a relatively large sealing surface, via the tapered member and the correspondingly tapered seat cooperating with it. Since the keg pressure is applied at the base of the tapered member and thereby apples a sealing force proportionately to the applied pressure, sealing will be improved with the pulled-out tap. However, simultaneously with the plunger being worked, the tapered member is pushed back and frees a relatively long taper gap, in which the pressure in the beer will be gently relieved, and no excessive foaming will develop at the outlet of the tap.

In a particularly preferred and simple manner, the tapered seat is part of an insert that is simply pushed into the inside tube and thus, in principle, does not require fixing because of the keg pressure applying against it. In this respect, a stop for example, assures that the insert or, respectively, the tapered member will end at a slight distance in front of the plunger, when the plunger is resting in its inactivated position. Additionally, the plunger can be provided with a sealing lip which is applied against a necked down portion of the inside tube, when the plunger is in its inactivated position. The seal according to the invention allows a very simple connection of the riser line to the tap. The connection comprises an end coupling member, in which a projection of the tap contacts with its outer surface (in the pushed-in condition of the tap) and covers the upper end of the riser line. The projection is preferably slit so that it can be resiliently pushed into the end coupling member located at the top of the riser line.

The plunger and the tapered valve are selectively operated via a button or other tap actuating mechanism, e.g., a lever mechanism. After sliding the tapered member radially inwardly, the button will again return, after being released, on its own into the starting position, e.g., spring-biased due to the keg pressure.

A preferred embodiment for the operation of the tap by means of a rubber button is disclosed in the above-cited commonly assigned patent, where fastening on the keg's sheet metal wall is also shown.

The same type of fastening can also be used for the installation of the pressure generator with the $CO_2$ cartridge. This device is arranged in an opening of the deep-drawn upper bottom of the keg, so that the cartridge can be tapped from the top; furthermore, stackability is thus maintained. See, e.g., U.S. Pat. No. 6,745,922.

A first preferred embodiment provides that the gas cartridge therein will be tapped; already upon the installation of the valve unit in the cover and its assembly with the protective cartridge housing. In this case, gas exiting the cartridge penetrates into a pressure space, with the built-up pressure being used to seal off this space via a valve (in the form of a reducing valve) until the tap valve unit is operated. As needed, the valve is operated from the outside, such that the mentioned sealing valve is opened against the force which the gas pressure exerts on it, so that gas can penetrate from the pressure space into a pressure regulating space. A spring system takes care that the pressure conditions in the two spaces are subsequently balanced against each other, so that a pressure of approx. 1.0 to 1.5 bar is adjusted in the interior of the valve unit. When this pressure is reached, the reducing valve will close again. When a higher pressure exists in the interior of the valve unit than in the inside space of the liquid container, gas can escape from the valve unit into the container's inside space. If, however, the pressure in the interior of the liquid container is higher than in the valve unit, a non-return valve will prevent penetration of liquid from the main space of the container into the pressure regulating space of the valve unit.

Alternatively, tapping of the cartridge can be effected from the outside but only at that point in time from which compensation of the pressure drop in the liquid container will be required. Activation of the valve unit then preferably effects simultaneously the tapping of the cartridge and the adjustment of the sealing valve to the above mentioned pressure balance. Even in this embodiment, it is possible to provide a non-return valve. However, instead or additionally, it can be provided that the tapping of the cartridge is done via a sleeve-like inside housing whose rotary movement results in an axial movement of a connected tapping point in the direction of the mouth of the gas cartridge. In this case, the presence of a rotatable inside housing in the outside housing of the valve unit can be used such that gas can escape from the pressure regulating space only when the gas cartridge is or, respectively, was tapped. For example, after this rotary movement, openings in the side wall of the inside housing and in the outside housing of the valve unit come into registry, so that gas can escape into the inside space of the container.

The valve unit for the pressure source according to the invention can be fastened in any fluid-tight manner in a corresponding opening of the liquid container. This opening is preferably found eccentrically in the cover area of the liquid container, as shown in FIG. 1.

For example, the upper end area of the valve mount of the valve unit can be connected with a ventilation valve plug which—aside from the fastening and sealing function—has activating means for transmitting a force into the interior of the valve unit which opens the sealing valve of the pressure space as above mentioned against the gas pressure, if this ventilation valve plug is used in combination with the above mentioned first embodiment of the invention. Instead, it can also be provided with means which enable the tapping of the gas cartridge according to the mentioned second embodiment of the invention, only after the complete installation and closing of the liquid container. The ventilation valve plug can have dimensions and sealing areas/latching claws such that it serves as a sealing plug for the valve unit according to the invention, by means of which the valve unit is anchored in the opening of the liquid container. Instead of using a ventilation valve plug, the valve unit can also be inserted directly with the aid of sealing means into the opening of the liquid container.

It is advantageous, in any event, for the valve unit according to the invention to comprise at least one safety system, by means of which an excessively high pressure in the pressure regulating space can be reduced and vented to the outside, into the environment of the liquid container. In the mentioned second embodiment of the invention, this system can also discharge overpressure into the liquid container. If a non-return valve is provided, this will not be required, however. Moreover, an additional second safety system may in some cases be desirable. In case of sealing problems in the immediate vicinity of the tapping point, the additional safety system will lead undesirable overpressure from the spaces existing there and discharge it to the outside.

Turning now to the drawings, in FIG. 1, keg 1 has $CO_2$ cartridge 2 arranged in its interior. The cartridge is preferably located inside a pressure reducer 3, which comprises a spring mechanism, as described above, for providing a pre-determined, preferably constant pressure condition in the interior of the keg. Tapping of the $CO_2$ cartridge 2 is done from above, for example, as schematically represented by the spike 19.

The interior of the keg includes a riser line 6 that ends in a terminal coupling 9, which is part of the tap 5. The tap is preferably formed from an outside tube 7 that is firmly connected with the keg wall, and carries on its inner end the coupling 9, and from an inside tube 8 that is slidably arranged in the outside tube. In the inside tube 8, a freely movable tapered member 15 is provided which is preferably conical and is pressed, by the internal pressure of the keg 1, into a correspondingly tapered, preferably conical seat 16 of an insert 20 located in the inside tube.

In front (radially outwardly) of the tapered member 15, a plunger 14 is provided which is held on the head 11 of the tap in a dispensing mechanism, such as rubber button 13. The beverage outlet 12 is located on the bottom of the head 11 of tap 5.

The keg 1 is delivered to the customer in the closed or inactivated position of the tap, with the inside tube 8 pushed into the outside tube 7 and with its projection 10 engaging in the coupling 9 and thus closing off the riser line 6 so that the tap is not subjected to pressure. The riser line and the beverage channel 21 are opened by pulling out the inside tube; this movement is also supported by beverage flowing under pressure into the channel 21.

Advantageously, the tap 5 is fixed to the keg in the manner described in DE 198 35 569, and its corresponding U.S. Pat. No. 6,401,989, the disclosure of which is hereby incorporated by reference in its entirety. In the same way, the rotational movement there described can be used for securing the tap and moving it out.

Figure 2:
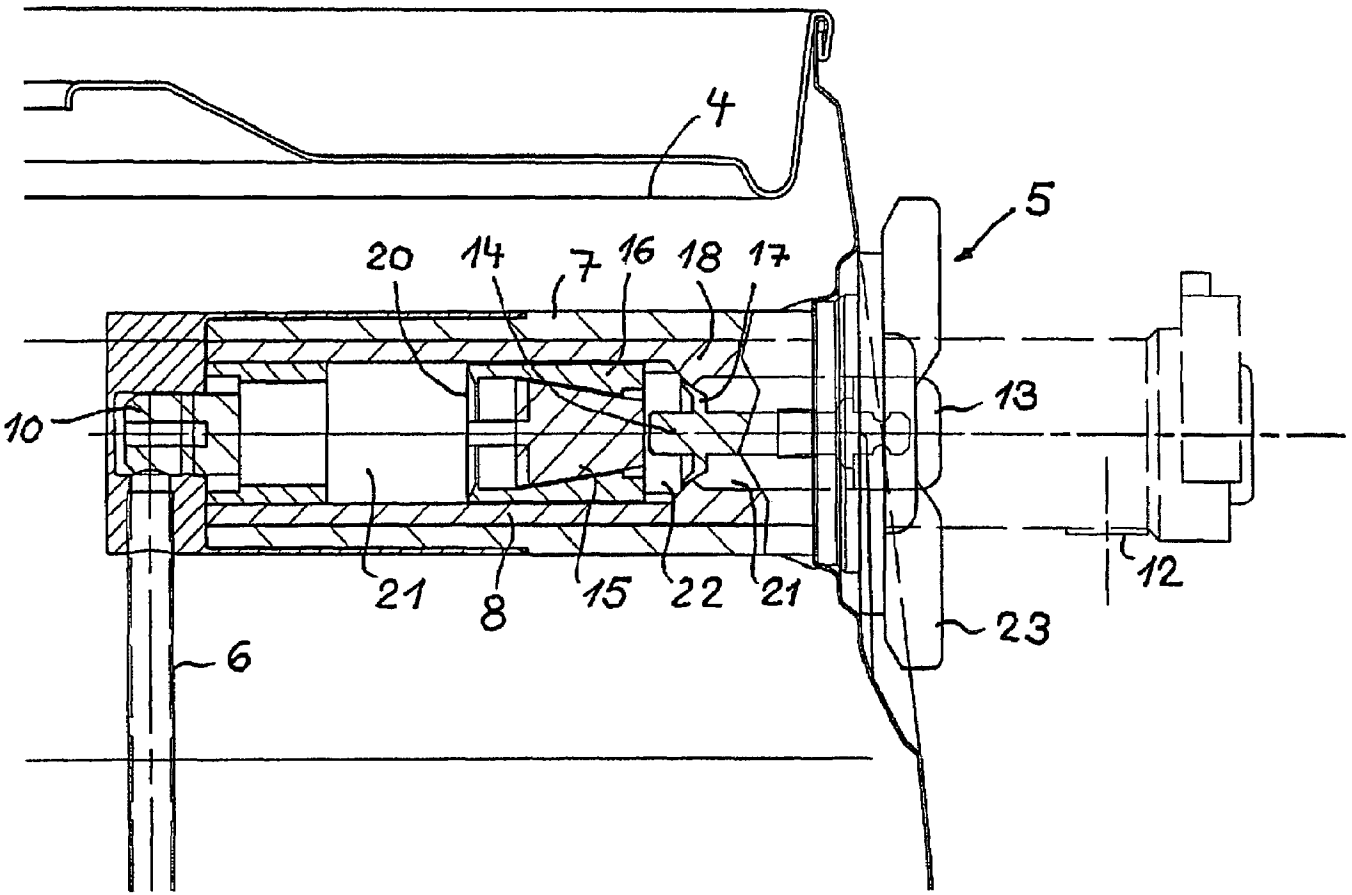
FIG. 2 is a detailed sectional view showing a portion of a preferred tap.

In the activated (pulled-out) position of the tap 5 shown in FIG. 1, the outlet 12 is doubly sealed against the beverage channel 21, as will be explained further below. Some of the structure will be seen in more detail in FIG. 2, in which, however, the tap is shown primarily in its closed or inactivated position, i.e., the inside tube 8 is pushed into the outside tube 7. The projection 10 thereby covers the upper end of the riser line 6, and the beverage channel 21 is not subjected to pressure. The beverage outlet 12 provided in the interior of the outside tube 7 is thus sealed or secured by three mechanisms: first, by blocking the riser line 6; then, by the tapered member positioned 15 in seat 16 blocking the beverage channel 21; and thirdly a seal is provided by the sealing lip 17 on the plunger 14, with the lip adjoining a necked-down portion 18 of the inside tube 8. Only the latter two sealing mechanisms apply in the activated position of tap 5 shown in FIG. 1.

The plunger 14 is preferably connected with the rubber-elastic button 13. When the button 13 is pushed, the plunger 14 is displaced and presses the tapered member 15 from its preferably conical seat 16. Thereby, a taper gap is formed between the two parts, and the beverage can flow out (in the activated position according to FIG. 1) with suppression of undesirably vigorous foaming. The beverage channel 21 continues into a directly following flare 22. The tap 5 is arranged close to the upper edge 4 of the keg 1; activation (pulling-out) of the tap 5 is preferably effected by the pulling on two wings 23, by means of which the inside tube 8 can be turned and unlocked.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A beverage container that is adapted to accept a pressurizing system having an internal $CO_2$ cartridge that can be selectively tapped from outside the container which has been sealed and a mechanism for maintaining a predetermined $CO_2$ pressure from the cartridge, the container comprising:

a tap provided on an upper edge of the container and being axially movable between a storage position, in which the tap is contained substantially within a volume of the container, and an activated position, in which the tap protrudes from one wall of the container; and a riser line positioned inside the container and connected to the tap;

wherein the tap comprises an outside tube in which an inside tube is slidably arranged, the outside tube being sealingly mounted in a container wall, a terminal coupling on an inner end of the outside tube for connecting to the riser line, a projection on the inside tube for closing the riser line when the tap is in the tap's storage position, a plunger at a radially outer end of the inside tube, coupled with a device for selectively axially displacing the plunger, a tapered member that is axially displaceable by the plunger and tapers in a beverage exit direction of the inside tube, movably positioned in the inside tube, and a tapered seat positioned in the inside tube and cooperating with the tapered member to form a selectively openable seal.

2. A container according to claim 1, wherein the tapered seat comprises a separate insert in the inside tube.

3. A container according to claim 1, further comprising a sealing lip positioned on the plunger and a necked-down portion of the inside tube that is arranged to cooperate with the sealing lip to form a seal.

4. A container according to claim 2, further comprising a sealing lip positioned on the plunger and a necked-down portion of the inside tube that is arranged to cooperate with the sealing lip to form a seal.

5. A container according to claim 1, wherein the device for selectively displacing the plunger comprises a rubber button.

6. A container according to claim 2, wherein the device for selectively displacing the plunger comprises a rubber button.

7. A container according to claim 3, wherein the device for selectively displacing the plunger comprises a rubber button.

8. A container according to claim 1, wherein the container comprises a keg for a malted beverage.

9. A container for dispensing a carbonated beverage, comprising:

a sealable container having associated therewith a self-contained system for providing a predetermined pressure level of $CO_2$ within a volume of the container;

a tap provided on an upper edge of the container and being axially movable between a storage position, in which the tap is contained substantially within the container volume, and an activated position, in which the tap protrudes from one wall of the container;

a riser line positioned inside the container and connected to the tap;

wherein, the tap comprises an outside tube in which an inside tube is slidably arranged, the outside tube being sealingly mounted in a container wall, a terminal coupling on an inner end of the outside tube for connecting to the riser line, a projection on the inside tube for closing the riser line when the tap is in the tap's storage position, a tapered member that is axially displaceable in the inside tube and tapers in a beverage exit direction of the inside tube, and a tapered seat positioned in the inside tube and cooperating with the tapered member to form a selectively openable seal; and a device for selectively axially displacing the tapered member.

10. A container according to claim 9, wherein the tapered seat comprises a separate insert in the inside tube.

11. A container according to claim 9, wherein the device for selectively displacing the tapered member comprises a plunger, and wherein the container further comprises a sealing lip positioned on the plunger and a necked-down portion of the inside tube that is arranged to cooperate with the sealing lip to form a seal.

12. A container according to claim 9, wherein the device for selectively displacing the tapered member comprises a plunger adapted to displace the tapered member and a rubber button located at an external end of the tap that is adapted to displace the plunger.

13. A container according to claim 9, wherein the self-contained system for providing a predetermined pressure level of $CO_2$ within the container volume comprises a $CO_2$ cartridge positioned within the container and being coupled with a mechanism for maintaining a predetermined $CO_2$ pressure from the cartridge.

14. A container according to claim 13, further comprising a mechanism for selectively tapping the $CO_2$ cartridge from outside the container after the container is sealed.

* * * * *